US006113850A

United States Patent [19]

Bartges et al.

[11] Patent Number: 6,113,850

[45] Date of Patent: Sep. 5, 2000

[54] 2XXX SERIES ALUMINUM ALLOY

[75] Inventors: Charles W. Bartges, Delmont, Pa.; Gerald D. Scott; Thomas J. Klemp, both of Massena, N.Y.; M. Elise Hyland, Oakmont, Pa.; James A. Brock, Massena; Colleen Spillard, Norwood, both of N.Y.

[73] Assignee: Aluminum Company of America, Pittsburgh, Pa.

[21] Appl. No.: 08/287,915

[22] Filed: Aug. 9, 1994

Related U.S. Application Data

[63] Continuation-in-part of application No. 08/034,090, Mar. 22, 1993, abandoned.

[51] Int. Cl.[7] ..... C22C 21/12

[52] U.S. Cl. ..... 420/530; 148/416; 148/438; 148/550; 148/552; 148/690; 148/695; 148/699; 420/531; 420/537; 420/538; 420/554

[58] Field of Search ..... 420/530, 531, 420/537, 538, 554; 148/416, 438, 550, 552, 690, 695, 699

[56] References Cited

U.S. PATENT DOCUMENTS

| | | | |
|---|---|---|---|
| 2,026,575 | 1/1936 | Kempf et al. | 420/530 |
| 2,076,567 | 4/1937 | Kempf et al. | 420/537 |
| 2,076,568 | 4/1937 | Kempf et al. | 420/530 |
| 2,076,569 | 4/1937 | Kempf et al. | 420/535 |
| 2,076,570 | 4/1937 | Kempf et al. | 420/530 |
| 2,076,571 | 4/1937 | Kempf et al. | 420/530 |
| 2,076,572 | 4/1937 | Kempf et al. | 420/530 |
| 2,076,573 | 4/1937 | Kempf et al. | 420/530 |
| 2,076,574 | 4/1937 | Kempf et al. | 420/530 |
| 2,076,575 | 4/1937 | Kempf et al. | 420/535 |
| 2,076,576 | 4/1937 | Kempf et al. | 420/530 |
| 3,576,832 | 4/1971 | Becker et al. | 420/530 |
| 4,005,243 | 1/1977 | Baba et al. | 428/469 |
| 5,123,973 | 6/1992 | Scott et al. | 148/690 |
| 5,162,065 | 11/1992 | Scott et al. | 148/438 |

FOREIGN PATENT DOCUMENTS

| | | |
|---|---|---|
| 53-033909 | 3/1978 | Japan . |
| 62-074044 | 4/1987 | Japan . |
| 62-74044 | 4/1987 | Japan . |
| 62-174356 | 7/1987 | Japan . |

*Primary Examiner*—Deborah Jones
*Assistant Examiner*—Robert R. Koehler
*Attorney, Agent, or Firm*—Gary P. Topolosky

[57] ABSTRACT

An A-rated, aluminum alloy suitable for machining, said alloy consisting essentially of: about 4–5.75 wt. % copper, about 0.2–0.9 wt. % bismuth, about 0.12–1.0 wt. % tin, the ratio of bismuth to tin ranging from about 0.8:1 to 5:1, up to about 0.7 wt. % iron, up to about 0.4 wt. % silicon, up to about 0.3 wt. % zinc, the balance aluminum, incidental elements and impurities. On a preferred basis, this alloy contains about 4.4–5.0 wt. % copper, about 0.4–0.75 wt. % bismuth, about 0.2–0.5 wt. % tin, the ratio of bismuth to tin ranging from about 1:1 to 3:1, about 0.2 wt. % or less iron and about 0.2 wt. % or less silicon. The alloy is substantially lead-free, cadmium-free and thallium-free. There is further disclosed an improved method for making screw machine stock or wire, rod and bar product from this alloy by casting, preheating, extruding, solution heat treating, cold finishing and aging the same.

26 Claims, 2 Drawing Sheets

2XXX SERIES ALUMINUM ALLOY

This application is a continuation-in-part of U.S. application Ser. No. 08/034,090, filed Mar. 22, 1993, abandoned.

BACKGROUND OF THE INVENTION

1. Field of the Invention

This invention relates to the field of aluminum alloys, and more particularly to machinable aluminum alloys. The invention further relates to products made from such alloys, including but not limited to: screw machine stock; cold finished wire, rod and bar; extruded, cast, drawn or hot and cold rolled wire, rod and bar, and extruded, cast, drawn or hot and cold rolled forge stock.

2. Technology Review

There are several known machining alloys with 2011 and 6262 aluminum alloys (Aluminum Association designations) being among the most commonly sold. It is difficult to measure the machinability of an alloy, however. One ranking system that has been used for some time classifies machinability based on a letter scale with an "A" rating being most machinable, followed by "B", "C", "D" and "E" ratings taking into account the following characteristics:

(1) Chip Size. Smaller chip sizes are more desired because such chips simplify the machining operation and facilitate more effective heat removal from the tool-workpiece interface than larger chips. Chips must not be too small or they interfere with lubricant recirculation during the overall machining operation, such as by drilling or cutting. Long, thin chips by contrast tend to curl around themselves rather than break. Such chips, sometimes called curlings, may require manual removal from the machining area and are less effective than smaller chips at heat dissipation because larger chips tend to block the cooling lubricant.

(2) Tool Wear. Lower tool wear rates are desired to save money by increasing the amount of time a tool can be used before prescribed tolerances for a given workpiece are exceeded. Lower tool wear rates further increase productivity by reducing downtime due to tool changeovers.

(3) Surface Finish. Alloys exhibiting a very smooth exterior surface finish in the as-machined condition are more desired to eliminate or reduce the need for subsequent surface finishing operations, such as grinding and deburring.

(4) Machining Forces. Lower machining forces are more desired to: reduce power requirements and the amount of frictional heat generated in the workpiece, tool and tool head; or increase the amount of machining or metal removal that can be accomplished with the same power requirements; and (5) Mechanical and Corrosion Properties. Mechanical characteristics such as strength, or other properties such as corrosion resistance, may be "optional" with respect to machinability. They can also be rather important depending on the intended end use for the workpiece being machined.

Although the A through E rating system is based on the five parameters discussed above, the relative importance of each parameter changes as a function of intended end use. 2011 is currently the only aluminum machining alloy that is consistently "A"-rated. This composition contains about 5–6 wt. % Cu, up to about 0.3 wt. % Zn, up to about 0.7 wt. % Fe, up to about 0.4 wt. % Si, about 0.2–0.6 wt. % Bi and about 0.2–0.6 wt. % Pb. It can be desirable to reduce the amount of lead in some products. Legislation may be requiring Pb level reductions or even elimination from certain consumer goods. A substantially lead-free substitute for 2011 or 6262 aluminum is desirable.

In the late 1930's, Alcoa patented a machining alloy consisting of 6 wt. % copper, 1 wt. % bismuth, 0.1 wt. % tin and a balance of aluminum. However, the high bismuth-to-tin ratio (10:1) preferred by U.S. Pat. No. 2,026,575, at copper levels greater than 5.5 wt. %, produce a less favorable combination of tool wear, chip size and surface finish properties.

SUMMARY OF THE INVENTION

A principal objective of the present invention is to provide a substantially lead-free substitute for 2011 aluminum alloy. Another objective is to provide a substantially lead-free, aluminum alloy with excellent machinability, thereby resulting in reduced manufacturing costs through longer tool life and faster machining times. It is another objective to provide an alloy which can be substituted for 2011 aluminum alloy in most machining applications, especially those applications where strength properties of the finished product are less critical than machinability. Yet another major objective of this invention is to provide a lead-free, aluminum-copper-tin alloy with lower Bi:Sn ratios than those required by U.S. Pat. No. 2,026,575, but with better combinations of machining properties than this prior art composition.

Another principal objective of this invention is to provide an improved screw machine stock and wire, rod or bar product, together with improved methods for making the same by casting, preheating, extruding, solution heat treating, cold finishing and aging in various combinations of steps.

These and other objectives are met or exceeded by the present invention, one embodiment of which pertains to an aluminum alloy suitable for machining. The alloy consists essentially of: about 4–5.75 wt. % copper, about 0.2–0.9 wt. % bismuth, about 0.12–1.0 wt. % tin, the ratio of bismuth to tin ranging from about 0.8:1 to 5:1, up to about 0.7 wt. % iron, up to about 0.4 wt. % silicon, up to about 0.3 wt. % zinc, the balance aluminum, incidental elements and impurities. On a preferred basis, this alloy is made into screw machine stock or a product selected from wire, rod or bar. The alloy for such preferred applications contains about 4.4–5.0 wt. % copper, about 0.4–0.75 wt. % bismuth, about 0.2–0.5 wt. % tin, the ratio of bismuth to tin ranging from about 1:1 to 3:1, about 0.2 wt. % or less iron and about 0.2 wt. % or less silicon. This alloy is substantially lead-free and substantially cadmium-free as defined herein.

The invention further includes an improved method for making screw machine stock and wire, rod or bar product from this alloy by casting, preheating, extruding, solution heat treating, cold finishing and aging, preferably to a T3, T8 or T851 temper (Aluminum Association designations). By extruding, cold finishing, and then solution heat treating (or solutionizing), this same alloy may be processed to such other tempers as T4, T451, T6 or T651. T9 tempering may also be available by solution heat treating, aging and then cold finishing the alloy of this invention.

BRIEF DESCRIPTION OF THE DRAWINGS

Further features, objectives and advantages of the present invention will be made clearer by reference to the accompanying drawings in which.

DETAILED DESCRIPTION OF PREFERRED EMBODIMENTS

Figure 1:
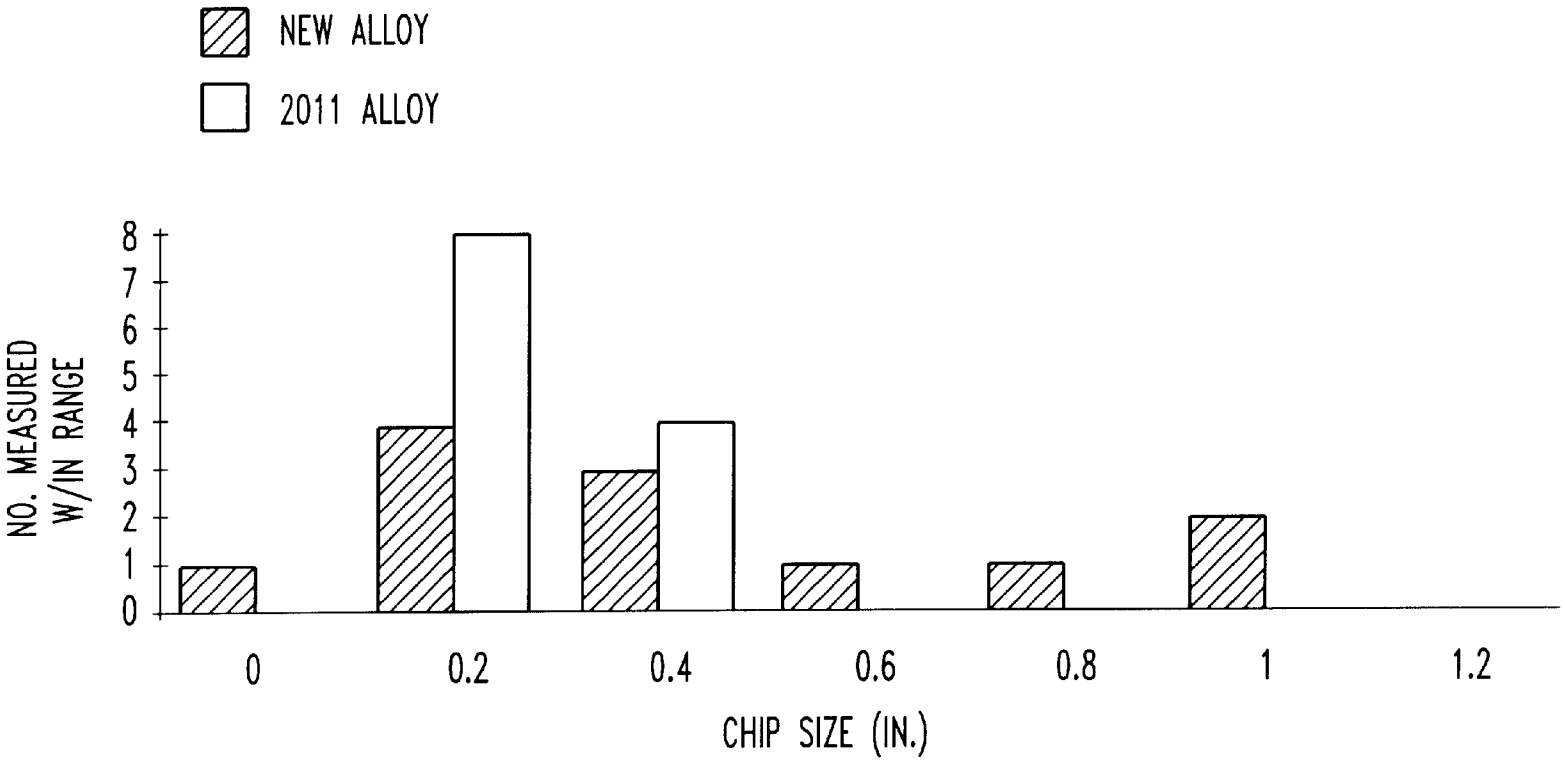
FIG. 1 is a graph comparing relative chip size distributions of the invention alloy versus a comparably-sized and machined workpiece made from 2011 aluminum alloy.

For any description of preferred alloy compositions, all references to percentages are by weight percent (wt. %) unless otherwise indicated.

When referring to any numerical range of values, such ranges are understood to include each and every number and/or fraction between the stated range minimum and maximum. A range of about 4–5.75% copper, for example, would expressly include all intermediate values of about 4.1, 4.2, 4.25 . . . 4.8 and 4.9% all the way up to and including 5.6, 5.7 and 5.749% Cu. The same applies to every other elemental range set forth below.

As used herein, the term "substantially-free" means having no significant amount of that component purposefully added to the alloy composition, it being understood that trace amounts of incidental elements and/or impurities may find their way into a desired end product. For example, a substantially Pb-free, machining alloy might contain less than about 0.1% lead, or less than about 0.03% Pb on a more preferred basis, due to contamination from incidental additives or through contact with certain processing and/or holding equipment. All embodiments of the present invention are substantially Pb-free. Most preferably, the invention alloy is also substantially free of cadmium and thallium.

The term "screw machine stock", as used herein, includes cold finished wire, rod and bar product together with any extruded wire, rod or bar product which can be hot and cold rolled by conventional ingot metallurgy techniques (e.g., DC casting) or otherwise manufactured using known or subsequently developed powder metallurgy, rolling and casting processes. "Cold processing" is defined as working with substantially ambient temperatures while "hot working" uses heated stock for further processing. It is to be understood that, in some instances, cold processing can follow hot working.

When referring to any preferred tempering treatment for this alloy, including T3, T4, T451, T6, T651, T8, T851 and T9, it is understood that current tempering practices include: hot working; cold working; solution heat treating (or solutionizing); and precipitation hardening, either naturally (i.e., at ambient or room temperature) or artificially (using an external heat source). Particulars about any one tempering method may be learned from Aluminum Association registration guidelines, the disclosures of which are fully incorporated by reference herein.

While the aluminum alloy of this invention can be made into screw machine stock and wire, rod or bar product, preferably by extrusion, casting and/or hot or cold rolling, it is to be understood that the same alloy may be made into other forms and product shapes, including sheet, strip, plate, forgings, clad or foil products, by any known or subsequently developed technique, including continuous or semi-continuous casting.

With respect to the main alloying elements, it is believed that the copper content of this aluminum-based alloy contributes to its machinability, strength, anodizing response, weldability and corrosion resistance response. The presence of tin is believed to contribute to machinability, mechanical properties and artificial aging response. Bismuth is believed to contribute to machinability, especially the overall chipping characteristics of the alloy. Iron and silicon are generally present as impurities. Although it is important to minimize impurity levels, the alloy of this invention has shown some ability to accommodate higher than average levels of Fe and/or Si contaminants even to the point of purposeful additions.

Tin is considered a viable substitute for lead for several reasons. Sn satisfies a majority of the criteria used to discern and develop a substantially lead-free substitute for 2011 aluminum, namely: (1) having a low toxicity level; (2) generating minimal processing complications when substituting for 2011 aluminum; (3) forming a low melting eutectic; (4) being generally insoluble in solid aluminum; (5) forming substantially no intermetallics with aluminum; and (6) having a net expansion upon melting.

The following examples are provided to further illustrate the objectives and advantages of this invention. They are not intended to limit the scope of this invention in any manner.

EXAMPLES

A 15-inch diameter ingot was cast to a final composition of: 5.63 wt. % copper, 0.4 wt. % tin, 0.49 wt. % bismuth, 0.52 wt. % iron, 0.05 wt. % silicon, the balance aluminum, incidental elements and impurities (including 0.01 wt. % titanium and 0.01 wt. % zinc). This ingot was preheated for extruding into a 0.843 inch diameter rod using a 5300 ton direct press and 14-hole die, a target temperature of 750° F. and extrusion speed of 35 ft/min. After solution heat treatment, this rod product was cold finished to a final diameter of 0.75 inch and aged by standard T3 temper practices. A 12-foot length of this rod was then sectioned off into specimens for machining under four different parameters (varying by tool design and cutting speed) and along the front (F), middle (M) and rear (R) of each specimen. The machined chips from each specimen were then measured and averaged for comparing chip performance of the invention alloy with that for a comparably sized and tempered section of 2011 aluminum alloy.

For yet another comparison of pertinent bismuth-to-tin alloy composition ratios, the following alloys were cast and the respective data measured:

| Sample | Wt. % Cu | Wt. % Sn | Wt. % Bi | Bi:Sn ratio | Tool Wear No. Parts Made | Tool Life Total Hours |
|---|---|---|---|---|---|---|
| A | 6 | 1 | 0.11 | 0.11 | 1,200 | 5.5 |
| B | 4.7 | 0.62 | 0.135 | 0.22 | 4.200 | 19.3 |
| C | 4.7 | 0.67 | 0.275 | 0.4 | 3,470 | 15.9 |
| D | 4.7 | 0.13 | 0.66 | 5 | 11,600 | 15.9 |
| Invtn. | 4.7 | 0.35 | 0.5 | 1.4 | 13,307 | 61.0 |

FIG. 1 illustrates the relative distribution of chip sizes (in inches) for the invention alloy and 2011 aluminum. From that figure, a primary advantage of the invention becomes evident. With the foregoing substantially lead-free composition, the number of chip sizes that were produced under all test machining conditions for the invention alloy were 0.4 inches or less in size. By contrast, a wider band of chip sizes was observed for 2011 aluminum.

Figure 2:
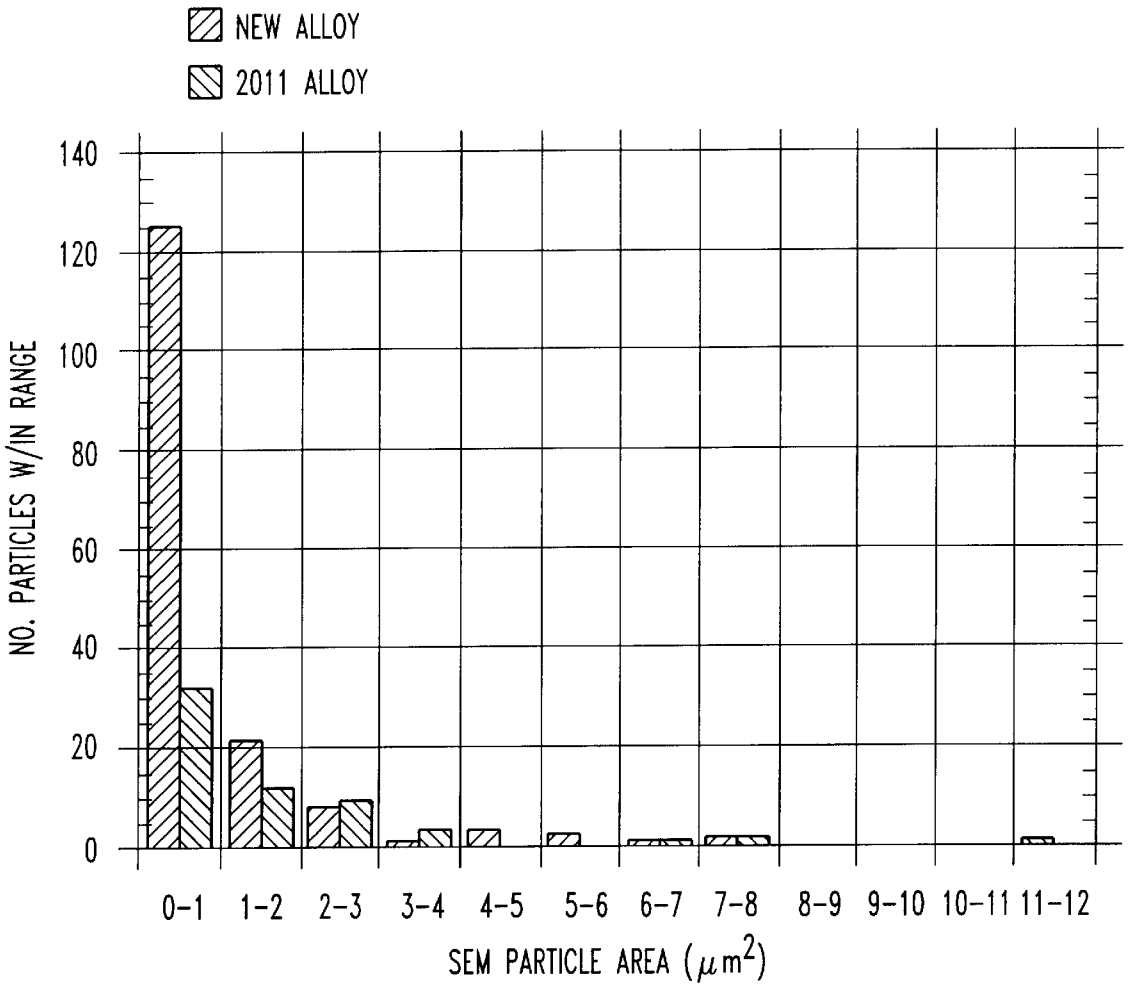
FIG. 2 is a graph comparing the size distributions of bismuth and tin-bearing particles in the invention alloy versus the size distributions of lead and bismuth-bearing particles in 2011 aluminum alloy.

For the comparison at FIG. 2, a scanning electron microscope (SEM)-based image analysis system was used to measure the distribution of chip breaking particles found in a commonly studied area of the invention alloy and 2011 aluminum machined specimens. In this common area, three times as many particles were found for the invention alloy as compared to 2011 aluminum. While the invention alloy produced more of such particles, the particles for the invention alloy were also consistently smaller in size than for the 2011 aluminum specimen.

Tensile strength comparisons between 2011 aluminum and the invention alloy revealed a decrease in strength for the invention alloy. Such tensile strengths were still within expected and acceptable T3 limits for many product sizes, however. Yield strength (YS) levels for the invention alloy were similarly close to typical 2011-T3 yield strength levels. Percent elongation and Ra values for the invention alloy were also comparable to those measured for the 2011 aluminum alloy specimen.

| Alloy | Typical Yield (ksi) | Typical Tensile (ksi) | % Elong. | Ra |
|---|---|---|---|---|
| 2011-T3 | 47.0 | 52.6 | 13.7 | 43.7 ± 1. |
| Invtn.-T3 | 43.2 | 47.9 | 15.5 | 40.2 ± 2. |

Another measuring system illustrates the ability of this invention alloy to generate a large number of chips per gram during machining, a larger number indicating that a relatively smaller chip size was being produced during machining. For this comparison, various target compositions were prepared both inside and outside the preferred copper levels for the invention alloy. Specimens from each composition were then machined at a front (F), middle (M) and rear (R) section, the latter numbers then being averaged for comparison with 24 representative samples of 2011 aluminum alloy as follows:

| | TARGET | | | | |
|---|---|---|---|---|---|
| Sample # | Wt. % Cu | Wt. % Sn | Wt. % Bi | Wt. % Fe | Avg. No. Chips/Gm. |
| 1 | 3.70 | .15 | .20 | .20 | 180 |
| 2* | 4.70 | .15 | .20 | .20 | 275 |
| 3* | 5.70 | .15 | .20 | .20 | 232 |
| 4* | 4.40 | .15 | .20 | .50 | 253 |
| 5* | 5.40 | .15 | .20 | .50 | 326 |
| 6 | 6.40 | .15 | .20 | .50 | 267 |
| 7 | 3.70 | .28 | .37 | .20 | 251 |
| 8* | 4.70 | .28 | .37 | .20 | 228 |
| 9* | 5.70 | .28 | .37 | .20 | 419 |
| 10* | 4.40 | .28 | .37 | .50 | 286 |
| 11* | 5.40 | .28 | .37 | .50 | 381 |
| 12 | 6.40 | .28 | .37 | .50 | 293 |
| 13 | 3.70 | .40 | .53 | .20 | 166 |
| 14* | 4.70 | .40 | .53 | .20 | 217 |
| 15* | 5.70 | .40 | .53 | .20 | 355 |
| 16* | 4.20 | .40 | .53 | .50 | 201 |
| 17* | 5.40 | .40 | .53 | .50 | 585 |
| 18 | 6.40 | .40 | .53 | .50 | 384 |

Avg. for the invention alloy specimens only (*) = 313
Avg. for 24 representative specimens of 2011 aluminum = 220

Using this measurement system, the higher number of chips-per-gram measured for the invention alloy illustrates that it is more likely to produce chips smaller in size than a machined equivalent made from 2011 aluminum.

Having described the presently preferred embodiments, it is to be understood that the invention may be otherwise embodied be the scope of the claims appended hereto.

What is claimed is:

1. A substantially lead-free 2000 Series aluminum alloy consisting essentially of: about 4–5.75 wt. % copper, about 0.2–0.9 wt. % bismuth, about 0.12–1.0 wt. % tin, the ratio of bismuth to tin ranging from 0.8:1 to 5:1, up to about 0.7 wt. % iron, up to about 0.4 wt. % silicon, up to about 0.3 wt. % zinc, the balance essentially aluminum with incidental elements and impurities.

2. The aluminum alloy of claim 1 which contains about 4.4–5.0 wt. % copper.

3. The aluminum alloy of claim 1 which contains about 0.2–0.5 wt. % tin.

4. The aluminum alloy of claim 1 which contains about 0.4–0.75 wt. % bismuth.

5. The aluminum alloy of claim 1 wherein the ratio of bismuth to tin ranges from 1:1 to 3:1.

6. The aluminum alloy of claim 1 which contains about 0.4–0.6 wt. % bismuth and about 0.25–0.4 wt. % tin.

7. The aluminum alloy of claim 1 which contains about 0.2 wt. % or less iron and about 0.2 wt. % or less silicon.

8. An improved screw machine stock made from a substantially lead-free, aluminum-based alloy consisting essentially of: about 4–5.75 wt. % copper, about 0.2–0.9 wt. % bismuth, about 0.12–1.0 wt. % tin, the ratio of bismuth to tin ranging from 0.8:1 to 5:1, up to about 0.7 wt. % iron, up to about 0.4 wt. % silicon, up to about 0.3 wt. % zinc, the balance aluminum, incidental elements and impurities.

9. The screw machin stock of claim 8 wherein the alloy contains about 4.4–5.0 wt. % copper.

10. The screw machine stock of claim 8 wherein the alloy contains about 0.2–0.5 wt. % tin and about 0.4–0.75 wt. % bismuth.

11. The screw machine stock of claim 8 wherein the ratio of bismuth to tin ranges from 1:1 to 3:1.

12. The screw machine stock of claim 8 wherein the alloy contains about 0.2 wt. % or less iron and about 0.2 wt. % or less silicon.

13. The screw machine stock of claim 8 wherein the alloy has been aged to a temper selected from the group consisting of T3, T4, T451, T6, T651, T8, T851 and T9.

14. An improved product selected from the group consisting of wire, rod and bar, said product made from a substantially lead-free, aluminum-based alloy consisting essentially of: about 4–5.75 wt. % copper, about 0.2–0.9 wt. % bismuth, about 0.12–1.0 wt. % tin, the ratio of bismuth to tin ranging from 0.8:1 to 5:1, up to about 0.7 wt. % iron, up to about 0.4 wt. % silicon, up to about 0.3 wt. % zinc, the balance aluminum, incidental elements and impurities.

15. The improved product of claim 14 wherein the alloy contains about 4.4–5.0 wt. % copper.

16. The improved product of claim 14 wherein the alloy contains about 0.2–0.5 wt. % tin and about 0.4–0.75 wt. % bismuth.

17. The improved product of claim 14 wherein the ratio of bismuth to tin ranges from 1:1 to 3:1.

18. The improved product of claim 14 wherein the alloy contains about 0.2 wt. % or less iron and about 0.2 wt. % or less silicon.

19. The improved product of claim 14 which has been aged to a temper selected from the group consisting of: T3, T4, T451, T6, T651, T8, T851 and T9.

20. The improved product of claim 14 which was manufactured by a method selected from the group consisting of: extrusion; casting; hot and cold rolling; and combinations thereof.

21. In a method for manufacturing a machinable aluminum-based alloy product selected from the group consisting of: screw machine stock; cold-finished wire, rod or bar; extruded wire, rod or bar; cast wire, rod or bar; and hot and cold-rolled wire, rod or bar, said manufacturing method including casting, preheating, extruding, solution heat treating, cold finishing and aging an aluminum-based alloy, the improvement which comprises providing as the alloy a substantially lead-free, substantially cadmium-free and substantially thallium-free composition consisting essentially of: about 4–5.75 wt. % copper, about 0.2–0.9 wt. % bismuth, about 0.12–1.0 wt. % tin, the ratio of bismuth to tin ranging from 0.8:1 to 5:1, up to about 0.7 wt. % iron, up to about 0.4 wt. % silicon, up to about 0.3 wt. % zinc, the balance aluminum, incidental elements and impurities.

22. The improvement of claim 21 wherein the alloy contains about 4.4–5.0 wt. % copper.

23. The improvement of claim 21 wherein the alloy contains about 0.2–0.5 wt. % tin and about 0.4–0.75 wt. % bismuth.

24. The improvement of claim 21 wherein the ratio of bismuth to tin ranges from 1:1 to 3:1.

25. The improvement of claim 21 wherein the alloy contains about 0.2 wt. % or less iron and about 0.2 wt. % or less silicon.

26. The improvement of claim 21 wherein the alloy is aged to a temper selected from the group consisting of: T3, T4, T451, T6, T651, T8, T851 and T9.

* * * * *